US010250964B2

(12) United States Patent
McGarry et al.

(10) Patent No.: US 10,250,964 B2
(45) Date of Patent: Apr. 2, 2019

(54) APPARATUS AND METHOD OF FORMING A CUSTOM EARPIECE

(71) Applicant: Logitech Europe S.A., Lausanne (CH)

(72) Inventors: Steve McGarry, Vancouver, WA (US); Steven Warren Pooler, Vancouver, WA (US); Steven Lee King, Vancouver, WA (US)

(73) Assignee: LOGITECH EUROPE S.A., Lausanne (CH)

( * ) Notice: Subject to any disclaimer, the term of this patent is extended or adjusted under 35 U.S.C. 154(b) by 16 days.

(21) Appl. No.: 15/591,559

(22) Filed: May 10, 2017

(65) Prior Publication Data

US 2018/0332379 A1 Nov. 15, 2018

(51) Int. Cl.
*H04R 1/10* (2006.01)

(52) U.S. Cl.
CPC ..... *H04R 1/1016* (2013.01); *H04R 1/105* (2013.01); *H04R 1/1058* (2013.01)

(58) Field of Classification Search
CPC .... H04R 1/1016; H04R 1/105; H04R 1/1058; H04R 25/658; H04R 25/652; H04R 2460/17; H04R 2225/023
See application file for complete search history.

(56) References Cited

U.S. PATENT DOCUMENTS 2,535,258 A * 12/1950 Bland ..... H04R 25/656 128/865
3,440,314 A * 4/1969 Frisch ..... H04R 25/608 128/864

(Continued)

FOREIGN PATENT DOCUMENTS

EP 2268063 A1 12/2010
WO 01/43495 A2 6/2001

(Continued)

OTHER PUBLICATIONS

Extended European Search Report dated Nov. 13, 2017 in European Patent Application No. 15799822.0 (European Publication No. 3149959), 10 pages.

*Primary Examiner* — Oyesola C Ojo
(74) *Attorney, Agent, or Firm* — Patterson & Sheridan, LLP

(57) ABSTRACT

Embodiments of the present disclosure generally relate to custom-fit in-ear audio devices. The custom-fit earpieces disclosed herein may include features providing superior retention in a user's ear while also maintaining desirable comfort and sound quality. The superior retention is generally provided by a curable filler disposed in a bladder that is deformed to conform to the shape of a user's outer ear as the filler material is cured. It has been found that a desired comfort level and sound quality can be achieved in a custom-fit earpiece by physically separating or at least partially decoupling the audio output member from other portions of the earpiece that are designed to enable the retention of the custom-fit earpiece within the user's ear. In some configurations, one of the portions of the custom-fit earpiece that is designed to enable the retention of the custom-fit earpiece within the user's ear includes a curable filler material that is disposed within a bladder that is coupled to a portion of the custom-fit earpiece.

18 Claims, 11 Drawing Sheets

(56) References Cited

U.S. PATENT DOCUMENTS 3,475,528 A * 10/1969 Parks ..... B29C 33/3885 264/222
4,657,106 A 4/1987 Hardt
4,712,245 A * 12/1987 Lyregaard ..... H04R 25/656 264/222
4,800,636 A * 1/1989 Topholm ..... H04R 25/608 181/129
4,834,211 A * 5/1989 Bibby ..... H04R 25/652 181/130
4,834,927 A * 5/1989 Birkholz ..... H04R 25/652 249/175
4,962,537 A * 10/1990 Basel ..... H04R 25/658 381/324
5,185,802 A * 2/1993 Stanton ..... H04R 25/60 181/129
5,321,757 A * 6/1994 Woodfill, Jr. ..... H04R 25/656 381/312
5,333,622 A * 8/1994 Casali ..... A61F 11/08 128/864
5,455,994 A * 10/1995 Termeer ..... H04R 25/652 264/222
5,530,763 A * 6/1996 Aebi ..... H04R 25/652 381/322
6,310,961 B1 10/2001 Oliveira et al.
D628,990 S 12/2010 Pedersen
D630,621 S 1/2011 Pedersen
D634,306 S 3/2011 Pedersen
8,630,436 B2 1/2014 Berg
8,682,001 B2 * 3/2014 Annunziato ..... G10K 11/16 381/71.8
8,897,458 B2 * 11/2014 Parkins ..... A61F 11/08 381/72
8,976,995 B2 3/2015 Berg
9,002,023 B2 * 4/2015 Gauger, Jr. ..... H04R 29/001 381/328
D744,456 S 12/2015 Pedersen
D773,440 S 12/2016 Pedersen
D773,441 S 12/2016 Pedersen
D774,021 S 12/2016 Pedersen
10,021,496 B2 * 7/2018 Clausen ..... H04R 1/1016
2006/0188119 A1 8/2006 Parker
2008/0044034 A1 2/2008 Hou
2009/0173353 A1 7/2009 Purcell et al.
2010/0019417 A1 1/2010 Chua et al.
2010/0278364 A1 11/2010 Berg
2011/0002491 A1 1/2011 Klemenz et al.
2011/0228963 A1 9/2011 Goldstein et al.
2012/0237068 A1 * 9/2012 Fretz ..... H04R 25/656 381/330
2013/0243209 A1 9/2013 Zurbruegg et al.
2014/0003644 A1 1/2014 Keady et al.
2014/0105431 A1 * 4/2014 Berg ..... H04R 1/1016 381/309
2015/0215693 A1 7/2015 Sandanger
2015/0281822 A1 10/2015 Berg
2015/0312665 A1 10/2015 Berg
2015/0374480 A1 12/2015 Grewe
2016/0205456 A1 7/2016 Berg
2016/0317352 A1 * 11/2016 Blumer ..... A61F 11/08

FOREIGN PATENT DOCUMENTS

WO 2005/125280 A2 12/2005
WO 2015/179975 A1 12/2015

* cited by examiner

APPARATUS AND METHOD OF FORMING A CUSTOM EARPIECE

BACKGROUND

Field

Embodiments of the present disclosure generally relate to custom-fit earpieces and methods for customizing an earpiece for use in a user's ear.

Description of the Related Art

Audio devices allow users to receive audio content or audio information from various media sources, such as internet, video players, gaming devices, music playing platforms or other types of audio generating devices. Typical portable in-ear audio devices may include various tethered and wireless headphones or other similar devices. Some common types of in-ear audio devices are in-ear monitors that provide an enhanced listening experience for studio recording, stage performance, and audiophile listening. To listen to recorded music, in-ear monitors may be hard-wired or wirelessly connected to a music player to listen to recorded music. In-ear monitors are superior to loudspeakers in that they facilitate a personalized mix of audio sources. In-ear monitors may reduce, eliminate or control ambient noise, including crowd and stage noise.

It is generally preferable to customize an in-ear audio device to a user's ear, so that the in-ear audio device is easily retained in the user's ear, and so that surrounding ambient noise can be eliminated or controlled. Traditionally, custom-fit in-ear audio device have used a wax-molding process to tailor the in-ear audio device to the unique shape of a user's ear. Although this wax-molding process can achieve a well-fitting custom in-ear audio device for a user, the process can be time-consuming and expensive. The process may require the user to travel to a location where a business can perform the wax molding of the user's ear. Then the user must wait multiple days until the custom in-ear audio device can be produced based on the wax molding and then sent to the user.

Therefore, there is a need for an improved custom-fit in-ear audio device and method of customizing the in-ear audio device that overcomes the deficiencies described above.

SUMMARY

Embodiments of the present disclosure generally relate to an in-ear audio device, or earpiece, and methods of customizing the earpiece for use in a user's ear. The earpiece may include a curable filler disposed in a bladder that can be deformed to conform to the shape of a user's ear. The earpiece and method of customizing the earpiece disclosed herein will improve a user's experience for customizing an earpiece to a user's ear and subsequent use by separating an audio output member of the earpiece from the portion of the earpiece including the curable filler. This separation enables an improved mechanical fit of the earpiece in the user's ear and also prevents the deformation of the bladder when the earpiece is customized to the user's ear from placing undesirable amounts of stress on the audio components in the audio output member, which can reduce sound quality.

Embodiments of the present disclosure may include an earpiece for providing sound to a user comprising a first body including a bladder and a curable filler disposed within the bladder, and an audio output member comprising a sound tube. The audio output member may be coupled to the first body at a flexible connection that is positioned therebetween. The flexible connection may also be positioned at a first location on the first body, and the audio output member is positioned outside of an exterior surface of the bladder.

Embodiments of the present disclosure may also include a method of customizing an earpiece to an outer ear of a user comprising placing an audio output member comprising a sound tube in an ear canal of a user, placing a first body in a cavum conchae of an outer ear of the user, wherein the first body comprises a bladder and a curable filler disposed in the bladder, the audio output member is coupled to the first body at a flexible connection that is positioned therebetween, the audio output member is coupled to the first body at a first location, and the audio output member is located outside of an exterior surface of the bladder, and applying a force to the first body to press the first body against the cavum conchae, wherein the force causes the first body to deform.

Embodiments of the present disclosure may further include an earpiece for providing sound to a user comprising a first body comprising a bladder, an outer body disposed around the bladder, and a curable filler disposed within the bladder, wherein the outer body includes a central portion extending around the bladder, the bladder consists of a first portion and a second portion, the first portion disposed entirely on a first side of the central portion of the outer body and the second portion disposed entirely on the second side of the central portion of the outer body, the second portion comprises at least 40% of a total volume of the bladder, an audio output member comprising a sound tube, wherein the audio output member is coupled to the outer body at a flexible connection that is positioned therebetween, the flexible connection is positioned at a first location on the outer body, and an orientation of the audio output member is adjustable in one or more dimensions relative to a stationary first body.

Embodiments of the present disclosure may also include a method of forming a customized earpiece, comprising positioning an earpiece within a portion of an ear of a user, wherein the earpiece comprises a first body that comprises an outer body supporting a bladder, and an audio output member that is coupled to the outer body of the first body at a first location. The process of positioning the earpiece may include positioning a sound tube of the audio output member in an ear canal of the ear of the user, and the first body in a cavum conchae of the ear of the user, urging the first body against the cavum conchae, and curing a curable filler material disposed within the bladder while urging the first body against the cavum conchae. The process of urging the first body against the cavum conchae causes the bladder and the outer body to deform and an angular orientation of the audio output member relative to the ear canal to adjust. The process of curing the curable filler material may include delivering one or more wavelengths of electromagnetic radiation to the curable filler material from an energy source to cause the bladder and the outer body to be fixed in the deformed state.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to custom-fit in-ear audio devices, also referred to herein as custom-fit earpieces or simply earpieces. The following discloses embodiments of custom-fit earpieces that include features providing superior retention in a user's ear while also maintaining desirable comfort and sound quality. The superior retention is generally provided by a curable filler disposed in a bladder that is deformed to conform to the shape of a user's outer ear as the filler material is cured. The retention of the custom-fit earpiece in the user's ear is also enhanced from an audio output member that is spaced apart from the bladder allowing the audio output member to be positioned at a desirable depth within the user's ear canal. It has been found that a desired comfort level and sound quality can be achieved in a custom-fit earpiece by physically separating or at least partially decoupling the audio output member from other portions of the earpiece that are designed to enable the retention of the custom-fit earpiece within the user's ear. In some configurations, one of the portions of the custom-fit earpiece that is designed to enable the retention of the custom-fit earpiece within the user's ear includes the curable filler material that is disposed within the bladder. The comfort level of the custom-fit earpiece described herein is enhanced because the audio output member can move independently or relative to the portion of the earpiece that includes the curable filler, thus allowing the audio output member to adjust to and comfortably fit within a given user's ear canal. The sound quality of the custom-fit earpiece may also be enhanced because the audio output member is spaced apart from the region of the custom-fit earpiece that contains the curable filler since the deformation of the curable filler during the customizing process will place a significant mechanical stress on any audio components (e.g., sound tube) of the audio output member disposed in the bladder with the curable filler due to the pressure applied to the bladder and curable filler material during the curing process.

Figure 1A:
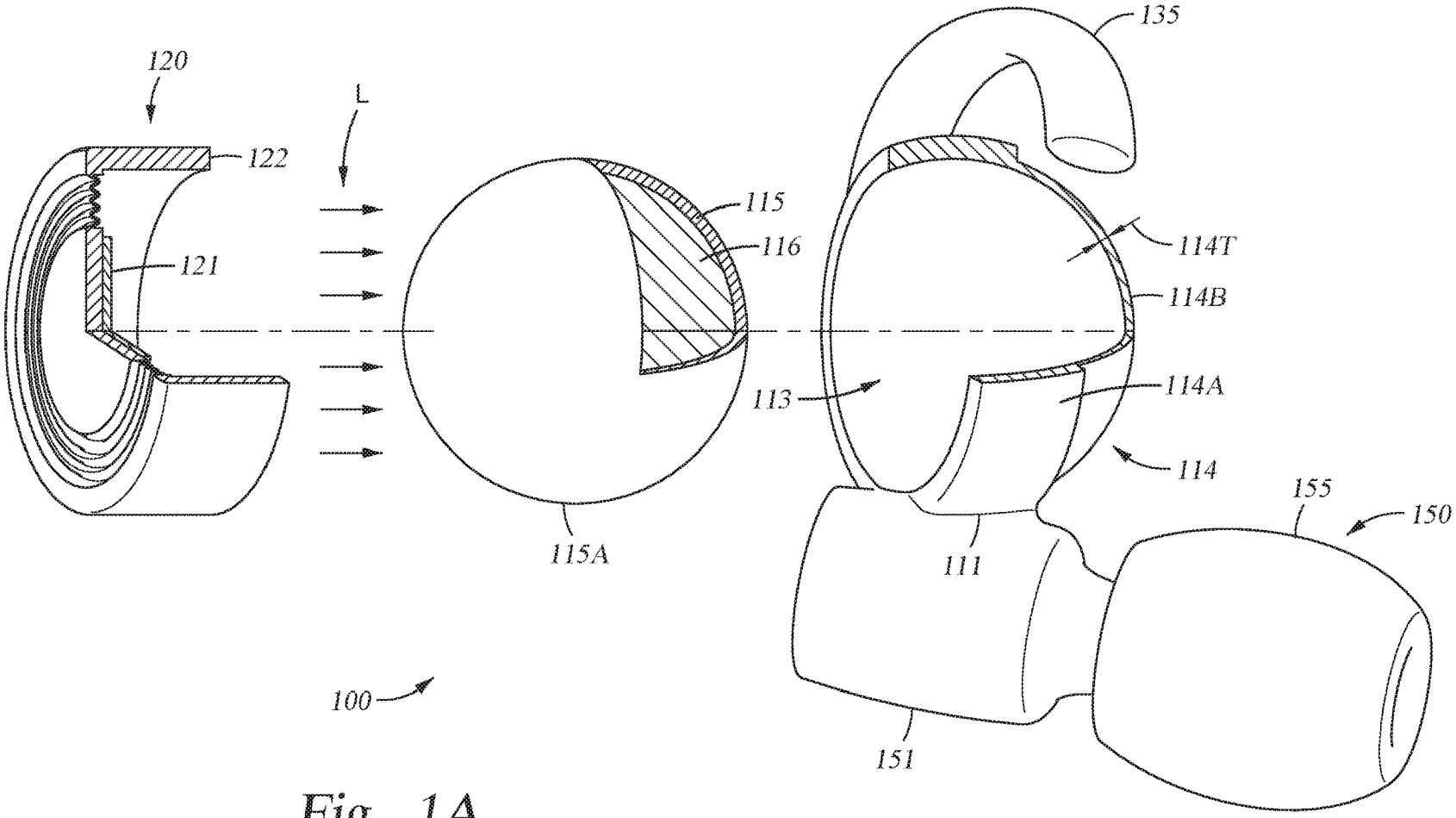
FIG. 1A is an exploded sectional view of an earpiece, according to one embodiment.
Figure 1B:
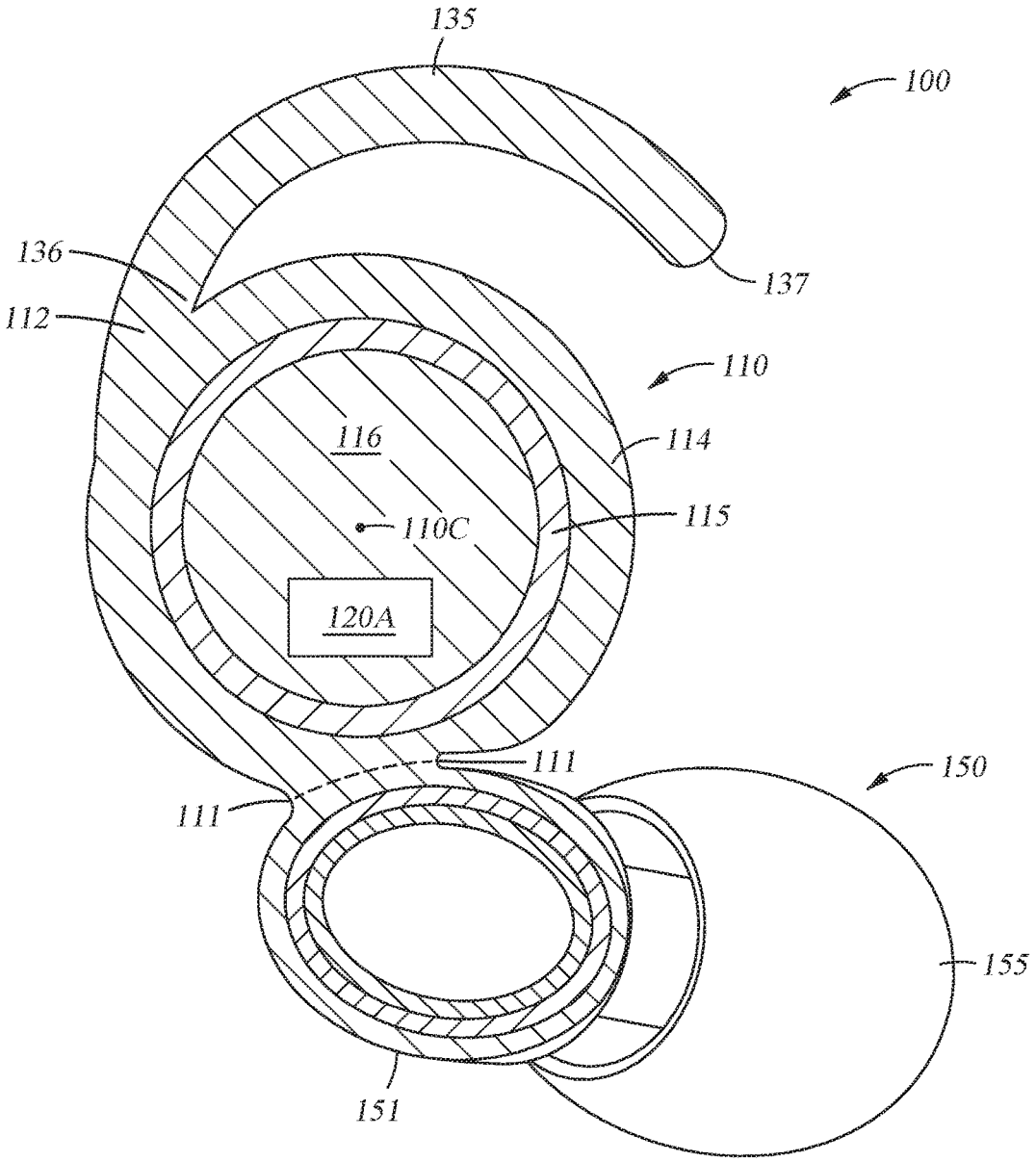
FIG. 1B is a partial side cross-sectional view of the earpiece of FIG. 1A, according to one embodiment.

FIG. 1A is an exploded sectional view of an earpiece 100, according to one embodiment. FIG. 1B is a partial side cross-sectional view of the earpiece 100, according to one embodiment. In general, the earpiece 100 described herein will include various types of in-ear audio devices, such as wired or wireless in-ear monitors, wired or wireless earbuds, hearing aids, and any other wearable devices that can be used to provide, block, and/or otherwise control sound received by a user's ear.

The earpiece 100 includes a first body 110, an audio output member 150, and a flexible tail 135. The first body 110 includes a curable filler 116 that can be deformed and then cured so that the deformed curable filler 116 will retain the shape of at least a portion of a given user's ear during a curing process, which is described further below. The audio output member 150 includes audio components (e.g., audio driver and sound tube) that provide audio to the user's ear during use of the earpiece 100. The first body 110 is connected to the audio output member 150 at a first connection location 111 on the first body 110. The audio output member 150 is configured to move independently in three dimensions relative to a stationary first body 110 enabling the audio output member 150 to comfortably fit within the user's ear canal during use of the earpiece 100.

The first body 110 can include an outer body 114 that is disposed around at least a portion of a bladder 115 that contains the curable filler 116. The outer body 114 can be formed of a thermoplastic material, such as a silicone or other similar flexible polymeric material. The outer body 114 can include a ring 114A and a concave feature 114B (e.g., a cup). The concave feature 114B can have a thickness 114T from about 1 mm to about 10 mm, such as about 2 mm. The bladder 115 can be disposed in a cavity 113 formed by the ring 114A and the concave feature 114B. In some embodiments, the ring 114A can seamlessly connect to the concave feature 114B. In some embodiments, the curable filler 116 is a curable photopolymer (e.g., a UV-curable polymer, such as a urethane acrylate or silicone) that is able to retain a desired fixed shape after performing a curing process. In other embodiments, the curable filler 116 may be another type of curable filler, such as a chemically curable filler (e.g., a reactive epoxy, urethane acrylate, or silicone). In some embodiments, the curable filler 116 can have a hardness from about 20 Shore A to about 50 Shore A, such as about 30 Shore A after a curing process has been performed.

In some embodiments, the bladder 115, which is configured to enclose and retain the curable filler material 116, can include one or more layers of material. In some embodiments, the bladder 115 will include one or more layers of material that are able to allow desired wavelengths of electromagnetic radiation (e.g., UV wavelengths) to pass therethrough so that the enclosed curable filler material 116 can be cured during the curing process by radiation provided from an electromagnetic source that is positioned outside of the bladder 115. In one embodiment the bladder 115 can be formed of a single layer of material. In some embodiments, the bladder 115 can include an inner layer that is formed from a flexible polymer, such as a polyurethane material. In some embodiments, the bladder 115 can further include an outer layer that can be formed of a flexible polymer, such as a thermoplastic or thermoplastic blend. In one embodiment, the bladder 115 is made from a polymeric material that has a durometer of between about 10 Shore A and 80 Shore A.

Furthermore, in some embodiments (see e.g., FIG. 1A), the outer layer of the bladder 115 can be formed as part of the outer body 114, such as concave feature 114B that has a thickness 114T. Although, the curable filler 116 can be designed to remain relatively soft after curing (e.g., having a hardness around 30 Shore A), the curable filler 116 can be rigid enough to resist the tendency of the bladder 115 and outer body 114 to return to its original shape, such as its shape prior to performing the curing process described below. In some embodiments, the original shape of the first body 110 is a spherical shape that has a diameter from about 6 mm to about 20 mm, such as about 13 mm.

In some embodiments, the earpiece 100 can further include an energy source 120 (see FIG. 1A). The energy source 120 can include a housing 122 and an energy emitting source 121 disposed in the housing 122. For example, FIG. 1A shows an energy emitting source 121 emitting electromagnetic radiation, light L towards the bladder 115 and curable filler 116. In some embodiments, the energy source 120 can be a light source, such as a UV light source. For example, in one embodiment, a UV light source that emits radiation at a wavelength from about 345 nm to about 420 nm, such as about 365 nm can be used to cure the curable filler 116.

The energy source 120 may be located outside (see FIG. 1A) of the bladder 115 or inside of the bladder 115 (see e.g., alternate light source 120A in FIG. 1B). As noted above, in some embodiments in which the energy source 120 is disposed outside of the bladder 115, the materials used to form the bladder 115 are transparent to the radiation emitted by the energy source 120. In some embodiments, some portions of the outer body 114, such as the concave feature 114B, are configured to be substantially opaque to the energy emitted by the energy source 120, so that the energy emitted by the energy source 120 is received by the curable filler 116 material disposed within the cavity 113 but not transmitted through the outer body 114 and to a portion of the user's body, such as a user's ear. In one embodiment, carbon black can be added to at least some portions of the outer body 114 that is formed from a silicone material to make the outer body 114 opaque to UV light.

In some embodiments in which the energy source is disposed inside the bladder 115, the outer body 114 and/or materials used to form the bladder 115 can be configured to be substantially opaque to the energy emitted by the energy source 120, so that the energy emitted by the energy source 120 is not transmitted through the earpiece 100 and to a portion of the user's body, such as a user's ear. In one embodiment, carbon black may be added to an outer layer of the bladder 115 to make the outer layer of the bladder 115 opaque to UV light.

In some embodiments, during the curing process the energy source 120 can be activated by a button or other input (not shown) on the earpiece 100 which causes a battery (not shown) disposed within the energy source 120 or the interior region 152 (FIG. 1C) of the earpiece 100, to power the light source disposed within the energy source 120. In other embodiments, the energy source 120 can be activated by a remote signal, such as a wired or wireless signal that is received by a wired or wireless transceiver (not shown) contained within the earpiece 100, such as within the I/O devices 162 described below. For example, in one embodiment, the energy source 120 is connected to the wireless transceiver that is adapted to receive a wireless signal (e.g., a Bluetooth signal) from an external electronic source (e.g., cell phone) that can cause the battery within the earpiece 100 to energize the energy source 120 to initiate the curing process.

The flexible tail 135 is connected to the first body 110 at a second location 112 on the first body 110. The flexible tail 135 extends lengthwise from a base 136 to an end 137. In one embodiment, the flexible tail 135 has a circular cross-section. The diameter of the cross-section may be uniform as the flexible tail 135 extends along its length. In one embodiment, the flexible tail 135 has a thickness (e.g., diameter) from about 1 mm to about 3 mm, such as about 2 mm. Furthermore, in one embodiment, the flexible tail 135 has a length from the base 136 to the end 137 from about 10 mm to about 30 mm, such as about 20 mm. The flexible tail 135 can be positioned against a portion of the user's ear to further enhance retention of the earpiece 100 in the user's ear. The flexible tail 135 can be formed as part of the outer body 114, and thus may be formed from a flexible polymer, such as a thermoplastic (e.g., silicone) or a thermoplastic blend. In one embodiment, the outer body 140 is made from a polymeric material that has a durometer of between about 10 Shore A and 80 Shore A.

The audio output member 150 includes audio components that provide audio to the user's ear during use of the earpiece 100. The audio output member 150 is configured to move relatively independently in three dimensions relative to the stationary first body 110 enabling the audio output member 150 to comfortably fit within the user's ear canal during use of the earpiece 100. The audio output member 150 is located outside of exterior surface 115A of the bladder 115, and in some embodiments, is attached to the ring 114A. Locating the audio output member 150 outside the bladder 115 prevents the customization process of the earpiece 100 (i.e., deforming the bladder 115) from damaging one of the audio components of the audio output member 150, such as the sound tube 166 described below. Furthermore, locating the audio output member 150 outside of the bladder 115 allows the audio output member 150 to deflect relative to the first body 110 including the bladder 115, so that the audio output member 150 can adjust to comfortably fit within a user's ear canal while the first body 110 including the bladder 115 can be positioned against the user's outer ear. It has been found that user's ear canals can extend in drastically different directions from one user of an in-ear audio device to the next, so having the orientation of the audio output member 150 decoupled from first body 110 can help to ensure a comfortable and appropriate fit for each user. Additional details regarding the configuration of the audio output member 150 is provided in relation to FIG. 1C below.

Figure 1C:
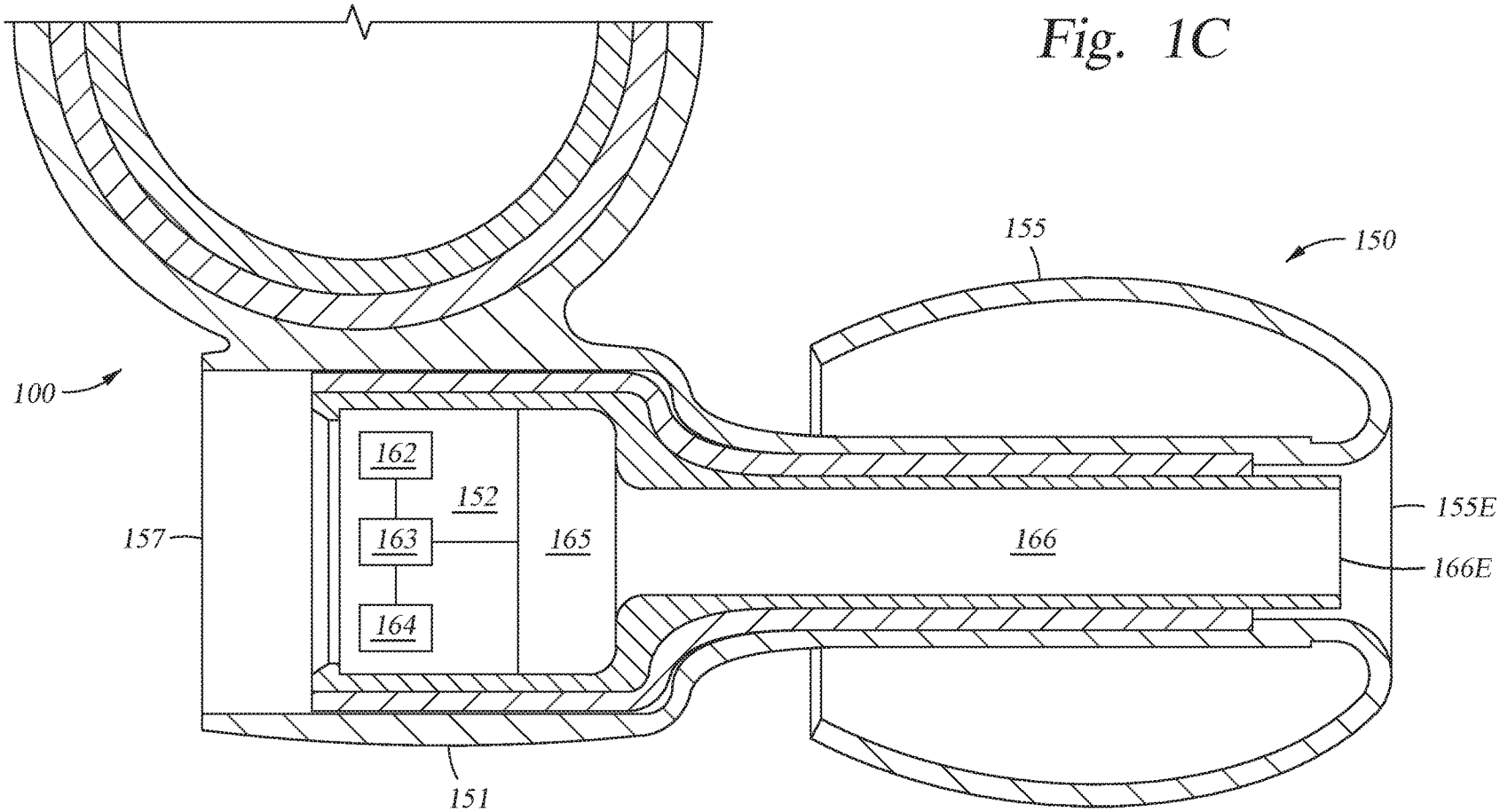
FIG. 1C is a cross-sectional view of the audio output member of the earpiece, according to one embodiment.

FIG. 1C is a cross-sectional view of the audio output member 150 of the custom-fit earpiece 100, according to one embodiment. The audio output member 150 includes an outer shell 151 and an ear tip 155 coupled to the outer shell 151. The audio output member 150 also includes an interior region 152 that is disposed within the outer shell 151. The outer shell 151 can also include a base 157 at the opposite end of the outer shell 151 from the ear tip 155. In some embodiments, the outer shell 151 can have a cylindrical shape with a diameter from about 6.5 mm to about 10.5 mm, such as about 8.5 mm.

The ear tip 155 includes an end 155E through which sound is projected towards the user's ear drum. The ear tip 155 can be configured to contact the user's ear canal during use of the earpiece 100. The ear tip 155 can be formed of a soft material, such as silicone or foam material.

The interior region 152 can include components for generating audio output. For example, the interior region 152 can include an audio driver 165 and a sound tube 166 coupled to the audio driver 165. The audio driver 165 is used to generate an audible output (e.g., one or more audio signals at frequencies >200 Hz) that is provided to the user of the earpiece 100 through the sound tube 166. The sound tube 166 can be positioned to project the audible output from the audio driver 165 into the user's ear canal. The sound tube 166 can extend from the audio driver 165 to an end 166E near the end 155E of the ear tip 155. Although only one audio driver 165 is shown, in some embodiments, the earpiece 100 may include two or more audio drivers and/or two or more sound tubes that can be used to produce the high-quality audio output commonly associated with some types of earpieces, such as in-ear monitors.

The interior region 152 can further include one or more electronic components for generating the audio output. For example, the interior region 152 can include a processing unit 163 coupled to input/output (I/O) devices 162, and to a memory unit 164. Memory unit 164 can include data (e.g., audio data) and one or more applications stored therein. Processing unit 163 may be any hardware unit or combination of hardware units capable of executing software applications and processing data, including, e.g., audio data. For example, processing unit 163 could be a central processing unit (CPU), a digital signal processor (DSP), an application-specific integrated circuit (ASIC), a combination of such units, and so forth. Processing unit 163 is configured to execute software applications, process audio data, and communicate with I/O devices 162 among other operations.

I/O devices 162 are also coupled to memory unit 164 and may include a plurality of electrical components capable of receiving various inputs and capable of providing various desirable outputs. For example, I/O devices 162 may include one or more transceivers configured to establish one or more different types of wireless communication links with other transceivers residing within other computing devices (not shown). A given transceiver within I/O devices 162 could establish, for example, a Wi-Fi communication link, a Bluetooth® communication link, or a near field communication (NFC) link, among other types of communication links. In some embodiments, the I/O devices 162 may further include an antenna (not shown), which is coupled to or disposed within audio output member 150 and also electrically coupled to a wireless transceiver that is configured to establish a wireless communication link with other transceivers residing within other external computing devices (not shown). I/O devices 162 may also include inputs (e.g., a 3.5 mm audio input jack) to receive audio input from an external wired audio source (not shown). I/O devices 162 may also include other inputs, such as one or more buttons or switches. I/O devices 162 may also include one or more outputs, such as status indicators (e.g., LEDs or speakers) or outputs (e.g., control relays) for controlling other outputs (e.g., energy source 120) in the earpiece 100. I/O devices 162 will also include one or more signal processing support components, signal filtering components (e.g., low pass and/or high pass filters) and components used to enable the delivery of an audible output from the driver 165 (e.g., signal amplifiers).

Memory unit 164 may be any technically feasible type of hardware unit configured to store data. For example, memory unit 164 could be a hard disk, a random access memory (RAM) module, a flash memory unit, or a combination of different hardware units configured to store data. Software application(s) within memory unit 164 can include program code that may be executed by processing unit 163 in order to perform various functionalities associated with the earpiece, such as playing or adjusting audio output and activating the energy source 120.

Figure 1D:
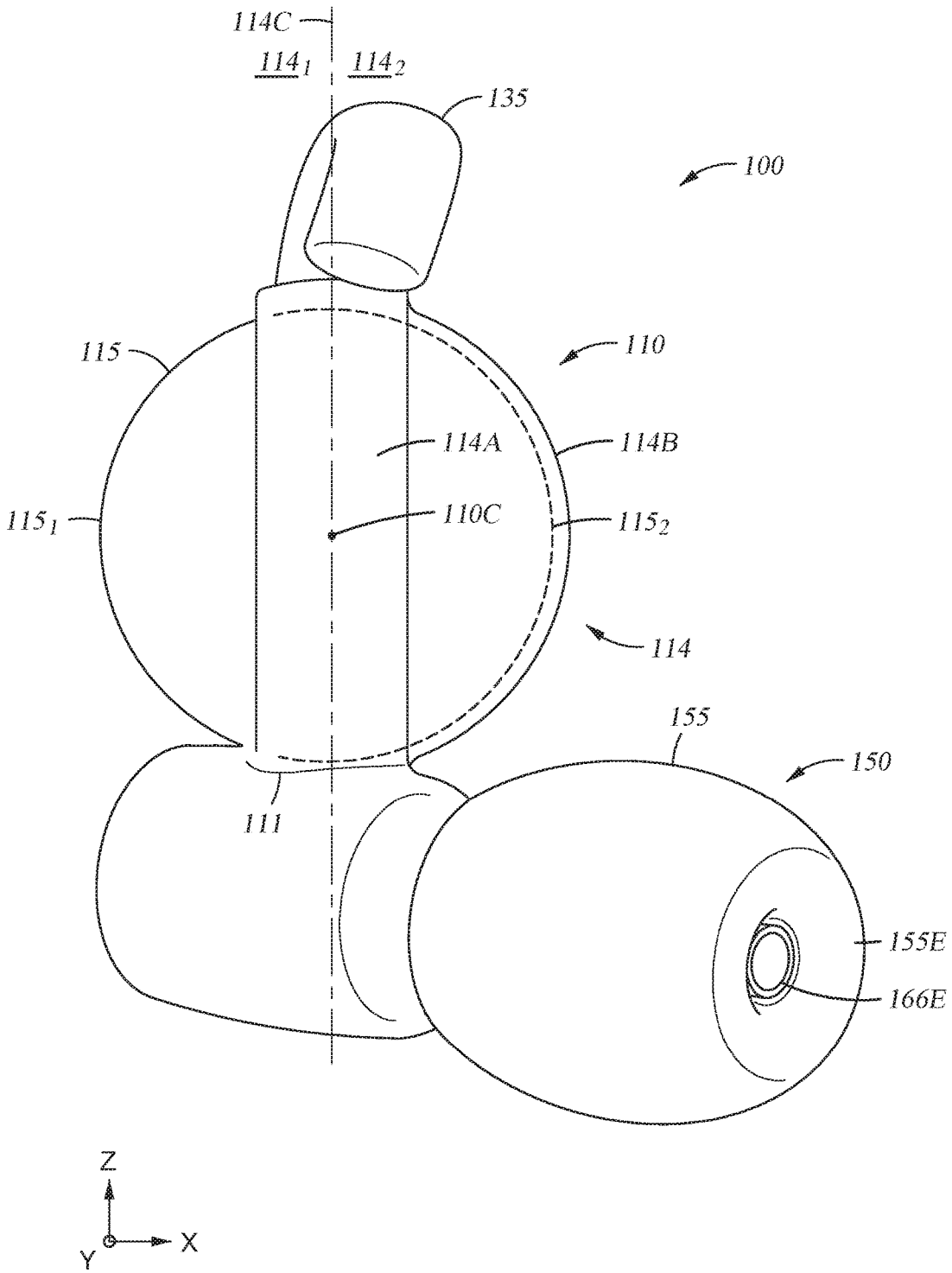
FIG. 1D is a perspective view of the earpiece, according to one embodiment.

FIG. 1D is a perspective view of the earpiece 100 prior to performing the curing process described below, according to one embodiment. The earpiece 100 includes the first body 110, which includes the outer body 114 that can be disposed around at least a portion of the bladder 115. The bladder 115 can include a first portion $\mathbf{115}_1$ and a second portion $\mathbf{115}_2$. The ring 114A of the outer body 114 can include a central portion 114C that divides the outer body 114 (e.g., bisects the outer body 114) in an angular direction (i.e., the direction in which the ring 114A of the outer body 114 extends around the bladder 115). For example, if the outer body 114 has a circular shape when viewed from the side as shown in FIG. 1B, then the central portion 114C can be a circumference of a circle formed around the bladder 115. The first portion $\mathbf{115}_1$ is disposed on a first side $\mathbf{114}_1$ of the central portion 114C. The second portion $\mathbf{115}_2$ is disposed on a second side $\mathbf{114}_2$ of the central portion 114C. The first portion $\mathbf{115}_1$ of the bladder 115 can be configured to be pressed by a user's hand when the user customizes the earpiece 100 to the user's ear during the curing process as described below in reference to FIG. 3. The second portion $\mathbf{115}_2$ can be configured to be pressed against a user's ear when the user customizes the earpiece 100 to the user's ear as described below in reference to FIG. 3.

In some embodiments, the first portion $\mathbf{115}_1$ and the second portion $\mathbf{115}_2$ can be substantially similar in size. For example, in some embodiments, the first portion $\mathbf{115}_1$ can have a volume within 20% of the volume of the second portion $\mathbf{115}_2$, such as within 10% of the volume of the second portion $\mathbf{115}_2$. In other embodiments, the first portion $\mathbf{115}_1$ and the second portion $\mathbf{115}_2$ can be nearly identical in size, such as where the volume of the first portion $\mathbf{115}_1$ is within 5% of the volume of the second portion $\mathbf{115}_2$, such as within 1% of the volume of the second portion $\mathbf{115}_2$. Furthermore, in some embodiments the bladder 115 can have a spherical shape prior to performing the curing process described below in reference to FIG. 3, where the first portion $\mathbf{115}_1$ is a first hemisphere of the sphere, and the second portion $\mathbf{115}_2$ is a second hemisphere of the sphere.

The audio output member 150 can be coupled to the first body 110 through the outer body 114. Furthermore, the audio output member 150 can be coupled to the outer body 114 at the central portion 114C, so that the second portion $\mathbf{115}_2$ is disposed on one side of the central portion 114C (i.e., the second side $\mathbf{114}_2$ of the central portion 114C) enabling the position and orientation of the audio output member 150 to be adjusted relative to a stationary second portion $\mathbf{115}_2$. Moreover, in some embodiments the second portion $\mathbf{115}_2$ has a volume that is at least 40% of the total volume of the bladder 115, such as at least 50% of the total volume of the bladder 115, such as at least 60% of the total volume of the bladder 115. It is contemplated that when the second portion $\mathbf{115}_2$ represents a larger portion of the total volume of the bladder 115, the position and orientation of the audio output member 150 may be more easily adjusted relative to the first body 110 when compared to similar embodiments of the earpiece where the second portion $\mathbf{115}_2$ represents a smaller portion of the total volume of the bladder 115.

The position and orientation of the audio output member 150 can be adjusted in three dimensions relative to a stationary first body 110 allowing the audio output member 150 to comfortably fit within a user's ear canal during use of the earpiece 100. Ear canals of different people can take significantly different routes from the entrance of the ear canal towards the user's ear drum, so this three-dimensional flexibility enables a comfortable fit of the audio output member 150 in a broad spectrum of potential users while allowing the first body 110 to be retained within portions of the user's outer ear, such as the conchae cavum as described below in reference to FIGS. 2A-2C. The three-dimensional movement of the audio output member 150 relative to the stationary first body 110 is greater before the curable filler 116 in the bladder 115 is cured, but in many embodiments there may still be some three dimensional flexibility of the audio output member 150 after the curable filler 116 has cured during the curing process.

Figure 1E:
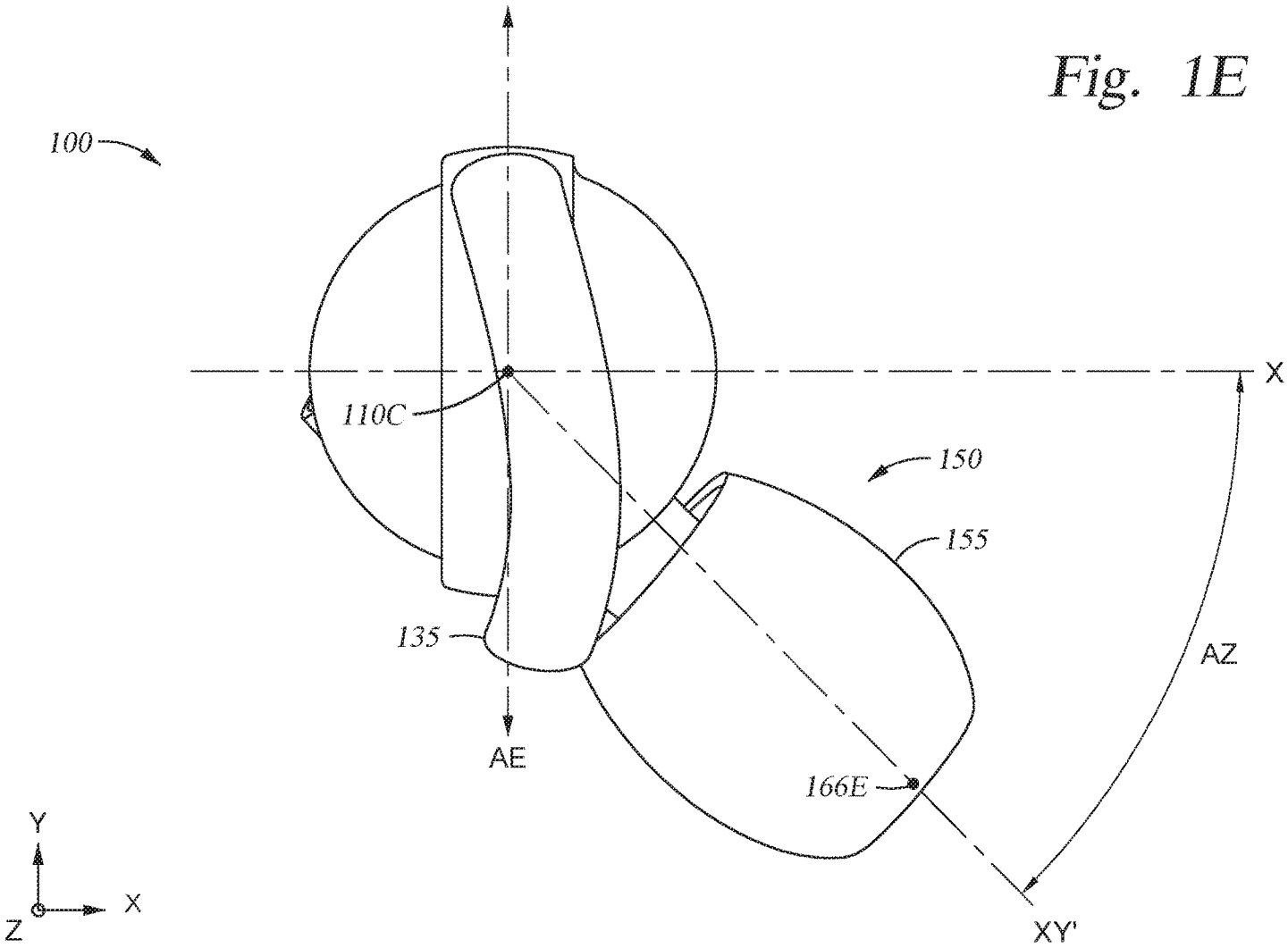
FIG. 1E is a perspective top view of the earpiece showing an azimuth illustrating a first orientation of an audio output member relative to a first body of the earpiece, according to one embodiment.
Figure 1F:
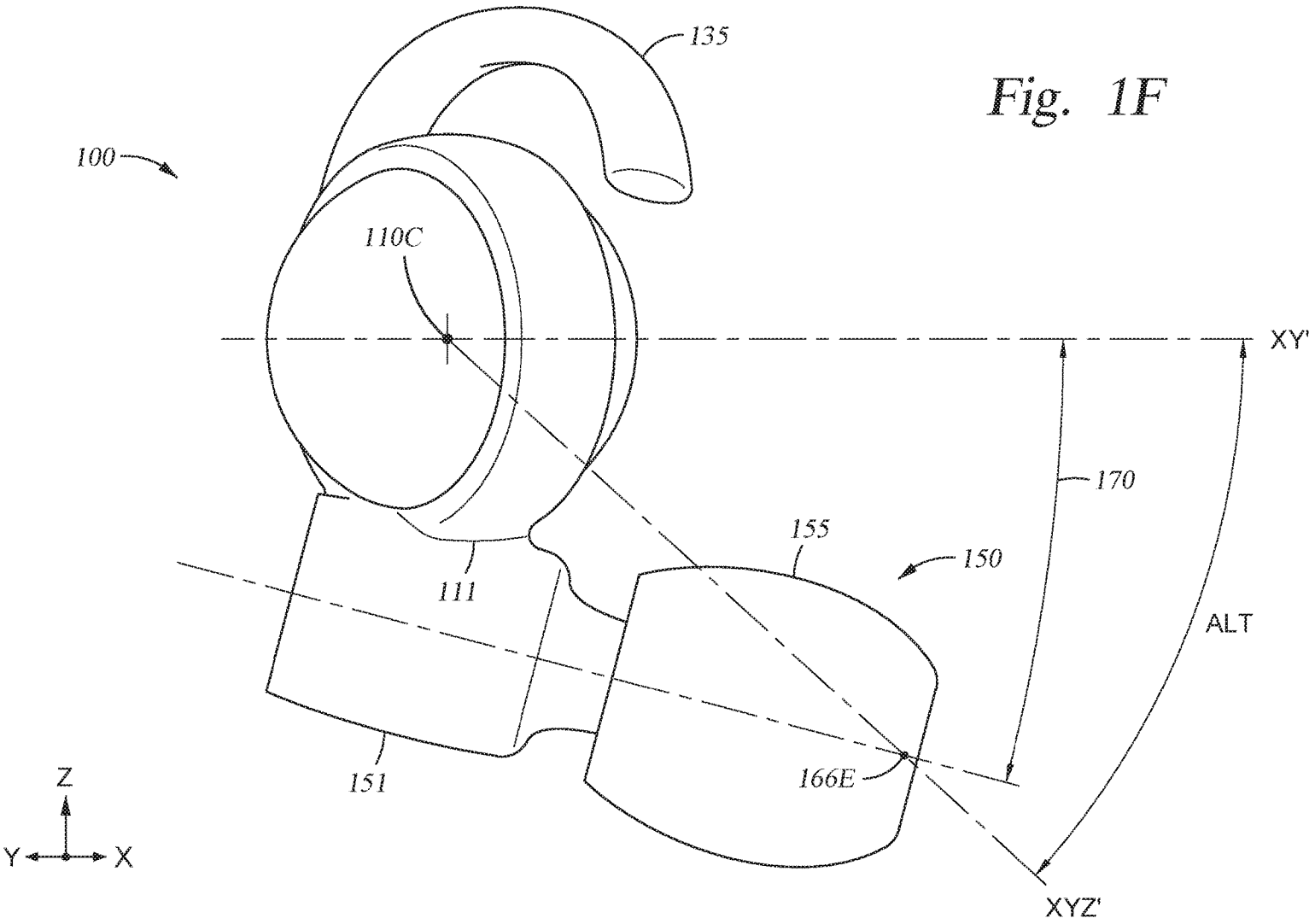
FIG. 1F is a perspective side view of the earpiece showing an altitude illustrating a second orientation of an audio output member relative to a first body of the earpiece, according to one embodiment

The three-dimensional movement of the audio output member 150 relative to a stationary first body 110, which occurs when the first body 110 is deformed during the curing process and when the earpiece 100 is inserted and reinserted into a user's ear after the curing process has been performed, may be described in terms of two angles, an azimuth AZ (see FIG. 1E) and an altitude ALT (see FIG. 1F).

FIG. 1E is a perspective top view of the earpiece 100 showing an azimuth AZ illustrating a first orientation of the audio output member 150 relative to the first body 110, according to one embodiment. In FIG. 1E, the X-axis is represented by a horizontal line extending from an origin (i.e., X, Y, and Z=0) located at the three dimensional center 110C of the first body 110 when the earpiece 100 is oriented so that the central portion 114C (see FIG. 1D) of the first body 114 is positioned at zero in the X direction (i.e., the central portion 114C of the first body 114 is disposed within an YZ plane). In FIG. 1E, the azimuth AZ is the angle between the X-axis and a first reference line XY' in the XY plane (i.e., Z=0). The first reference line XY' passes through the same XY coordinates as the end 166E of the sound tube 166. The azimuth AZ can be used to indicate the direction in an XY plane at which the end 166E of the sound tube is oriented relative to the X-axis extending from the center of the first body 110.

FIG. 1F is a perspective side view of the earpiece 100 showing an altitude ALT illustrating a second orientation of the audio output member 150 relative to the first body 110, according to one embodiment. The altitude ALT is the angle between the first reference line XY' and a second reference line XYZ' that passes through the same XYZ coordinates as the end 166E of the sound tube 166. Thus, the first reference line XY' and the second reference line XYZ' both pass through the same XY coordinates where the end 166E of the sound tube 166 is located and differ at these locations only by the Z-coordinate. Thus, the altitude ALT can be used to identify the vertical direction (i.e., Z-direction) at which the end 166E of the sound tube 166 is oriented relative to the first reference line XY'.

FIG. 1F also shows an initial angle 170 of the audio output member 150 relative to the X-axis before the curing process is performed, defining how the audio output member 150 is initially oriented in a vertical direction. The initial angle 170 can be configured with a starting orientation of the audio output member 150 that more closely matches the angle of a user's ear canal across a broad population of users or a subset of the broader population. In some embodiments, the initial angle 170 can be between 10 and 50 degrees, such as 30 degrees.

In some embodiments, the audio output member 150 is oriented in the XY plane relative to a stationary first body 110 such that the azimuth AZ (FIG. 1E) in an earpiece 100 is set to one of many desired orientations so that the configured orientation of the audio output member 150 in a horizontal plane is able to fit a particular user. In other words, an earpiece 100 may be originally formed such that the audio output member 150 is configured in one of many pre-set discrete angular orientations so as to fit many different groups of the human population. In other embodiments, the audio output member can move (e.g., rotate) in the XY plane relative to a stationary first body 110 before the curing process is performed allowing the user to adjust the audio output member 150 to a proper and comfortable orientation in the user's ear canal before curing the curable filler material 116.

In some embodiments, during the curing process the azimuth AZ may be adjusted by about 45 degrees in either direction relative to a starting orientation of the audio output member 150. For example if the starting orientation is set at an azimuth AZ of 50 degrees relative to the X-axis, then the azimuth AZ may be adjusted between 5 degrees and 95 degrees relative to the X-axis.

Furthermore, in these embodiments, the audio output member 150 may also be flexible in the vertical direction such that the altitude ALT (FIG. 1F) may be adjusted during the curing process enabling the user to adjust the orientation of the audio output member 150 in a vertical plane. In some embodiments, the altitude ALT may be adjusted by about 45 degrees in either direction relative to a starting orientation of the audio output member 150. For example if the starting orientation is set at an altitude ALT of 70 degrees relative to the first reference line XY', then the altitude ALT may be adjusted between 25 degrees and 115 degrees relative to the first reference line XY'.

Figure 2A:
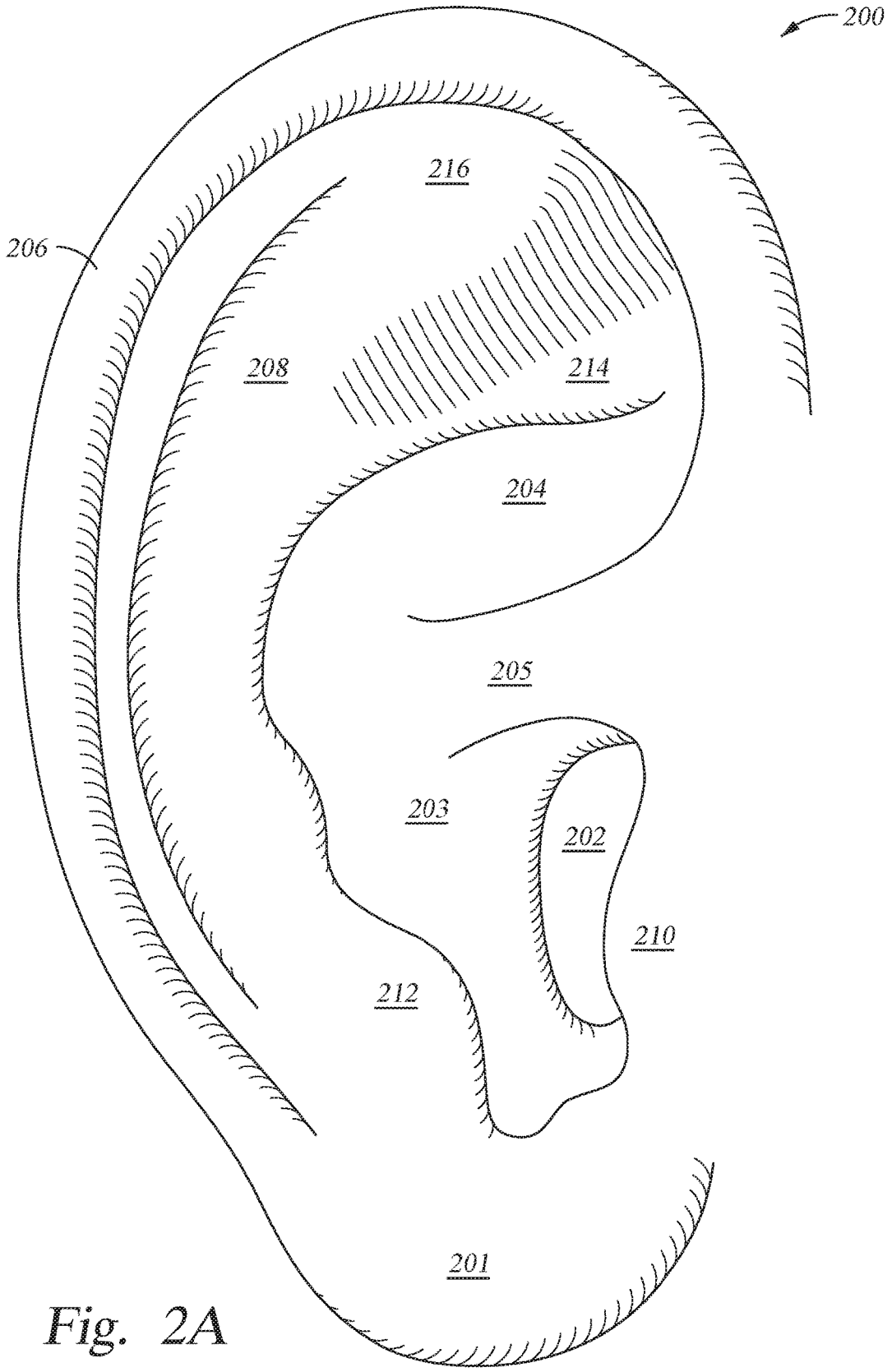
FIG. 2A is an exemplary illustration of a human outer ear.

FIG. 2A is an exemplary illustration of a human outer ear 200. The earpiece 100 is configured to conform to portions of a user's outer ear 200 for a snug and comfortable fit. A description of these portions of the outer ear 200 follows and is useful for understanding how the earpiece 100 conforms to a user's outer ear 200 in subsequent portions of this description.

The outer ear 200 includes an ear canal 202 leading to an ear drum (not shown). Ear lobe 201 forms a lower portion of the outer ear 200 and a helix 206 extends from the ear lobe 201 to a top portion of the outer ear 200. The ear canal 202 is surrounded by the cavum conchae 203, the crus helix 205, the tragus 210, and the antitragus 212. The cavum conchae 203 has a recessed shape (e.g., bowl shape) relative to the surrounding portions of the outer ear 200 other than the ear canal 202. The earpiece 100 can be placed in this recessed shape of the cavum conchae 203 as more fully described below. The antitragus 212 is a projection extending from the ear lobe 201 towards the ear canal 202. The tragus 210 is a projection extending from the face (not shown) towards and/or over the ear canal 202. The crus helix 205 is a spiny portion extending from above the tragus 210 to the cavum conchae 203. The antihelix 208 is disposed between the helix 206 and the crus helix 205. The antihelix 208 is separated from the crus helix 205 by the cymba conchae 204, which is recessed relative to the crus helix 205 and the antihelix 208. The portion of the antihelix 208 that is connected to the cymba conchae 204 is the crus antihelicis inferioris 214. The portion of the antihelix 208 that extends to the helix 206 is the crus antihelicis superioris 216.

Figure 2B:
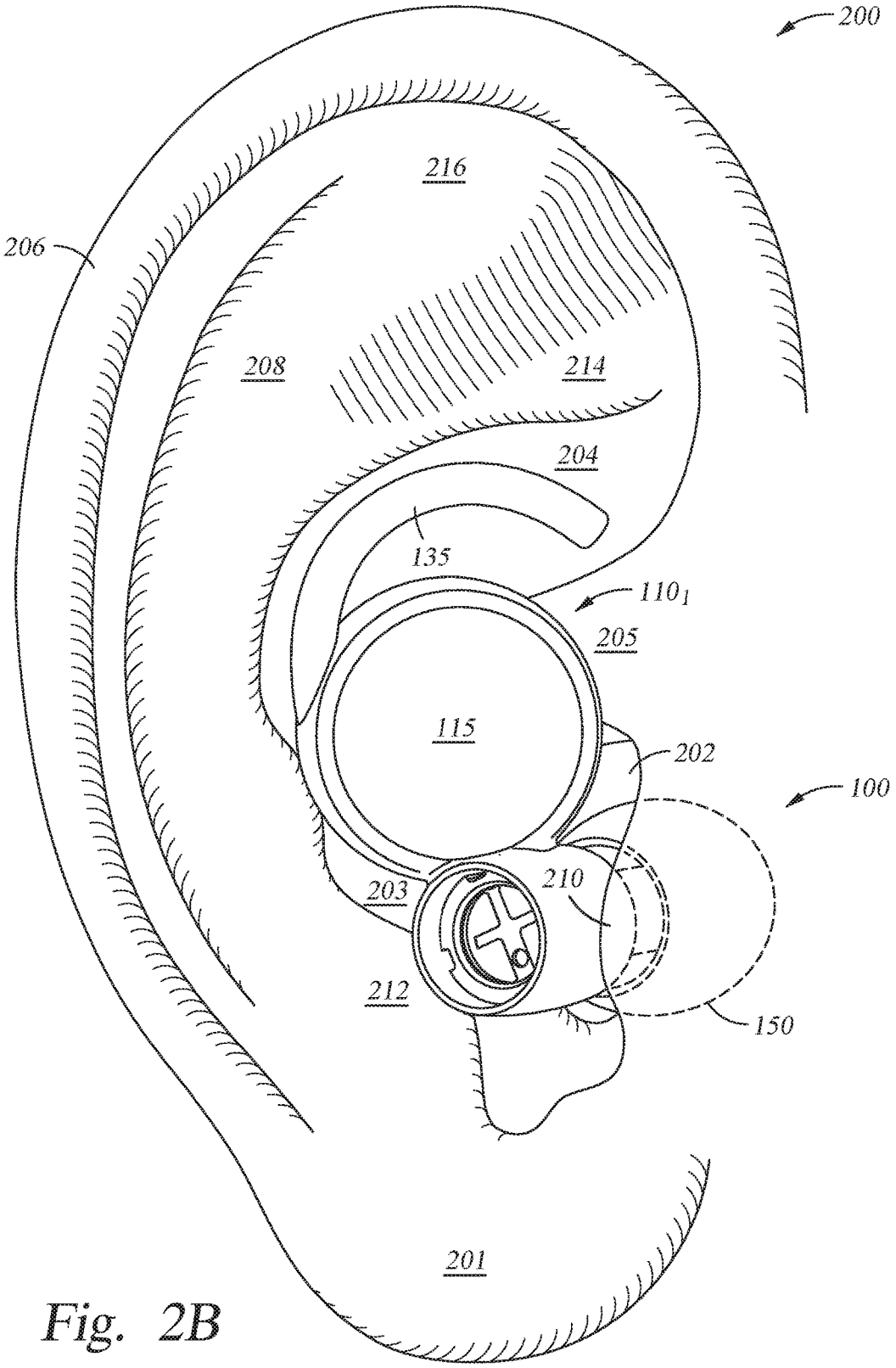
FIG. 2B is a perspective view of the earpiece of FIG. 1A disposed within a portion of the user's outer ear before a user customizes the earpiece to conform to the shape of the user's outer ear, according to one embodiment.

FIG. 2B is a perspective view of the earpiece 100 disposed within a portion of the outer ear 200 before a user customizes the earpiece 100 to conform to the shape of the user's outer ear 200 during the curing process, according to one embodiment. In FIG. 2B, the audio output member 150 is disposed at least partially in the ear canal 202. The first body 110 is disposed against the cavum conchae 203 and the cymba conchae 204 straddling the crus helix 205. The flexible tail 135 is disposed in the cymba conchae 204 being positioned to press against or proximate to a wall 204W (see FIG. 2C) of the cymba conchae 204 that leads to the crus antihelicis inferioris 214.

Figure 2C:
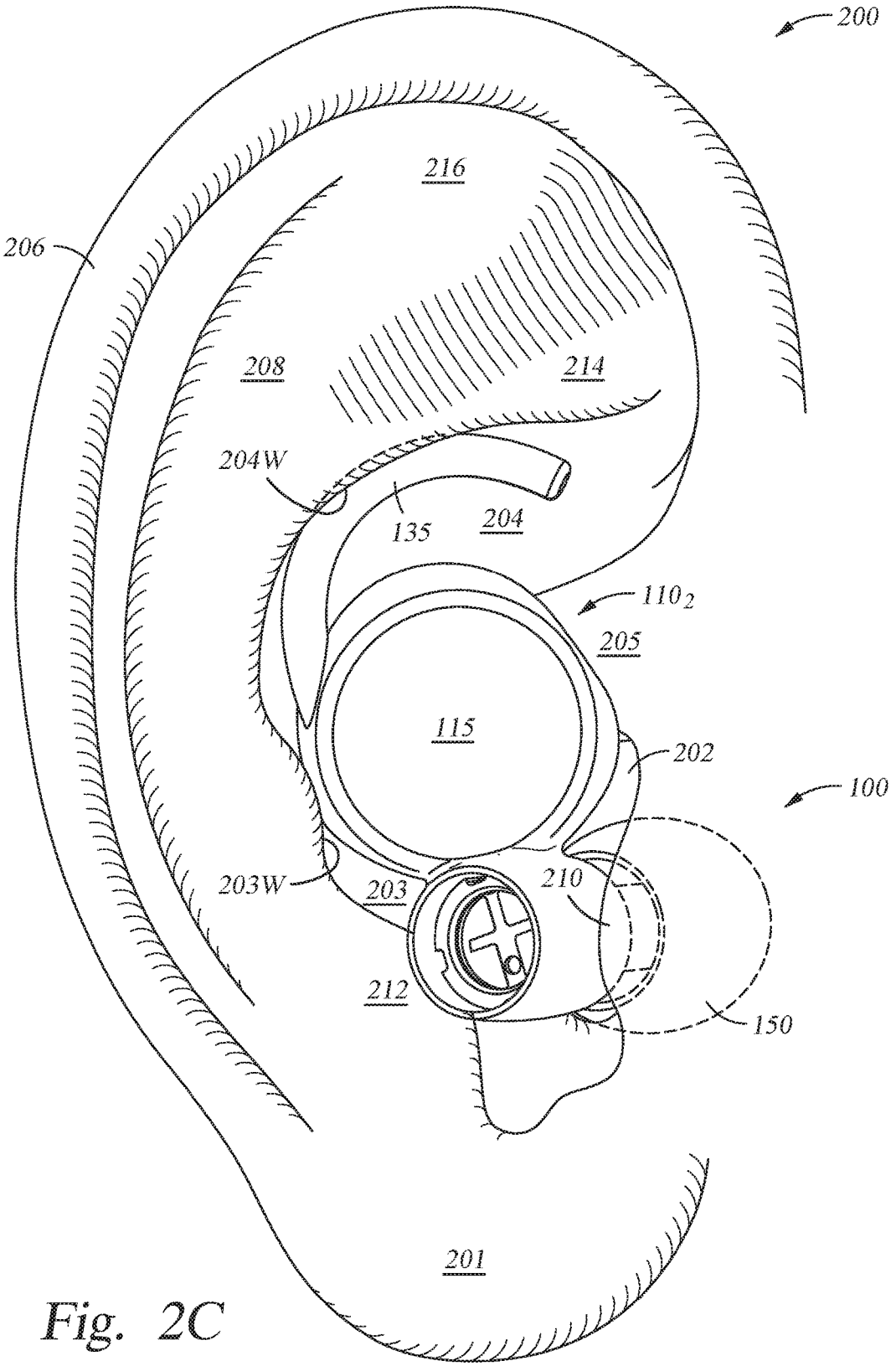
FIG. 2C is a perspective view of the earpiece of FIG. 1A disposed within a portion of the user's outer ear after a user customizes the earpiece to conform to the shape of the user's outer ear, according to one embodiment.

FIG. 2C is a perspective view of the earpiece 100 disposed within a portion of the outer ear 200 after a user customizes the earpiece 100 to conform to the shape of the user's outer ear 200 during the curing process, according to one embodiment. The user can customize the earpiece 100 to conform to the shape of the user's outer ear 200 by pressing the first body 110 against at least portions of the cavum conchae 203 and the crus helix 205, so that the first body 110 laterally expands until portions of the first body 110 contact portions of one or more of the tragus 210 and a wall 203W of the cavum conchae 203 opposing the tragus 210. The first body 110 can also contact the crus helix 205 and portions of the cymba conchae 204, such as a wall of the cymba conchae 204.

In FIG. 2C, the audio output member 150 is disposed at least partially in the ear canal 202, and the first body 110 is disposed against the cavum conchae 203 and the cymba conchae 204 straddling the crus helix 205. The flexible tail 135 is disposed in the cymba conchae 204 being positioned to press against the wall 204W of the cymba conchae 204 that leads to the crus antihelicis inferioris 214. During the customization process (e.g., curing process), the flexible tail 135 can be pressed deeper into the cymba conchae 204 and can align with the profile of the wall 204W of the cymba conchae 204 leading to the crus antihelicis inferioris 214 after the first body 110 has been deformed.

The orientation of the audio output member 150 relative to the first body 110 can be adjusted due to the flexible connection created between the first body 110 and the audio output member 150. Thus, the orientation of the audio output member 150 can be adjusted to a desired orientation in three dimensions relative to the first body 110. The flexible connection can be created by adjusting the shape and cross-sectional area of the first connection location 111 (FIGS. 1A-1B) and type of material(s) used to form the outer body 114 and outer shell 151. For example, in one embodiment, a thickness of the flexible connection at the first connection location 111 can be from about 3 mm to about 10 mm, such as between about 3.3 mm and about 9.6 mm, such as about 6.3 mm. In one example, the cross-sectional area of the first connection location 111 is between about 9 $mm^2$ and about 30 $mm^2$ to achieve a desired flexibility/stiffness at the first connection location 111 found between the first body 110 and the audio output member 150. Furthermore, in some embodiments, the flexible connection at the first connection location 111 can have a circular cross-section, so that the thickness is uniform throughout the flexible connection. In one configuration, the audio output member 150 is coupled to the first body 110 at a flexible connection that is positioned therebetween as, for example, illustrated in FIGS. 1A and 1B. In one embodiment, the cross-sectional area being the area that is shared by the adjoining material of the outer body 114 and outer shell 151 is positioned at the first connection location 111. Thus, the audio output member 150 can be oriented comfortably within the user's ear canal 202 before the first body 110 is customized to the user's outer ear 200, and not apply a significant load or strain on portions of the user's ear after the customization process has been performed. The orientation of the audio output member 150 relative to the first body 110 can change when the first body 110 is customized to conform to the user's outer ear 200. For example, portions of the first body 110 will generally laterally expand downward towards the antitragus 212, which can cause portions of the audio output member 150 to move downward in a corresponding fashion. As portions of the audio output member 150 move downward, the ear tip 155 can adjust its orientation relative to the base 157 of the audio output member 150, so that the ear tip 155 maintains a comfortable fit in and applies a minimal load to the user's ear.

In some embodiments, the orientation of the audio output member 150 relative to the first body 110 can be locked in place after the curable filler 116 is cured when the user customizes the earpiece 100 to the user's outer ear 200. Locked in place, herein refers to an orientation that the audio output member 150 has when there are no external stresses are applied to the audio output member 150 relative to the first body 110. Thus, the orientation of the audio output member 150 relative to the first body 110 may still be flexible in three dimensions after the curable filler 116 of the first body 110 is cured, but the stress-free orientation of the audio output member 150 is set during the curing process.

In some embodiments, the audio output member 150 can be connected to the first body 110 or a portion of the earpiece 100 between the first body 110 and the audio output member 150 by a joint (e.g., a ball joint, not shown). In some embodiments, the joint can allow the audio output member 150 to rotate 360 degrees relative to the first body 110. In some embodiments including a joint, the first body 110 may be configured so that a portion of the curable filler 116 expands into the ball joint when the first body 110 is deformed by the user to conform to the user's outer ear 200, so that the orientation of the audio output member 150 relative to the first body 110 is locked into place as described above when the curable filler 116 is cured. In other embodiments, a filler similar to the curable filler 116 can be placed in the joint, so that the joint can allow free movement before the filler in the joint is cured. The filler in the joint may be during a portion of the curing process and/or cured by the same method as the curable filler 116 is cured, such as a UV cure process. After the filler in the joint is cured, the orientation of the audio output member 150 relative to the first body 110 can be locked in place as described above.

Figure 2D:
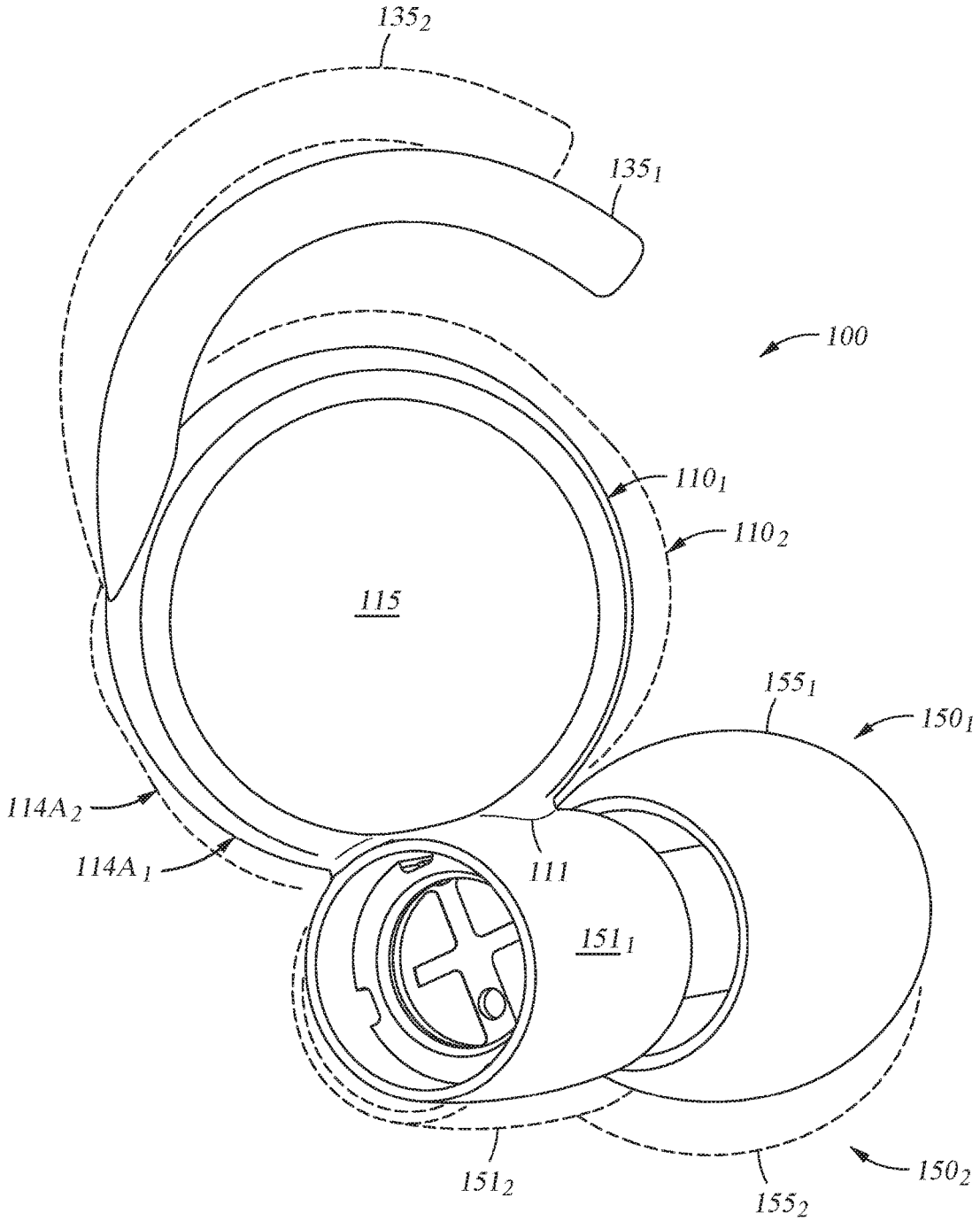
FIG. 2D is a perspective view of the earpiece further illustrating the effects of customizing the earpiece to a user's ear, according to one embodiment.

FIG. 2D is a perspective view of the earpiece 100 further illustrating the effects of customizing the earpiece 100 to a user's ear during the curing process, according to one embodiment. In FIG. 2D, the first body 110 deforms from an original shape (shown as first body $\mathbf{110}_1$ including outer body $\mathbf{114}A_1$) to a deformed shape (shown as first body $\mathbf{110}_2$ including outer body $\mathbf{114}A_2$) after the user has conformed the earpiece 100 to the user's ear by use of the steps described in FIG. 3 below. During the customization process, the flexible tail 135 can move from a first position and orientation (shown as flexible tail $\mathbf{135}_1$) to a second position and orientation (shown as flexible tail $\mathbf{135}_2$), due to the load applied to the bladder 115 and outer body 114 of an undeformed first body during the curing process. The customized flexible tail $\mathbf{135}_2$ has moved upward relative to the original flexible tail $\mathbf{135}_1$, so that the customized flexible tail $135_2$ can press against portions of the user's ear, such as the wall 204W of the cymba conchae 204 described above in reference to FIG. 2C.

Furthermore, the audio output member 150 can move from a first position and orientation (shown as audio output member $150_1$ of an undeformed first body) to a second position and orientation (shown as audio output member $150_2$), due also to the load applied to the bladder 115 and outer body 114 during the curing process. As illustrated in FIG. 2D, the customized audio output member $150_2$ has moved downward relative to the original audio output member $150_1$. For example, the outer shell 151 and ear tip 155 have each moved downward from a first position (shown as outer shell $151_1$ and ear tip $155_1$) to a second position (shown as outer shell $151_2$ and ear tip $155_2$). Although FIG. 2D shows the outer shell 151 and the ear tip 155 moving downwards relative to their original positions, the actual movement of the outer shell 151 and the ear tip 155 can depend on the shape of a given user's ear. In some embodiments, the ear tip 155 of the audio output member 150 can be pushed deeper into the ear canal 202 (see FIG. 2A) of the user as a result of the customization process, further improving the secureness of the fit of the earpiece 100 in the user's ear.

Figure 3:
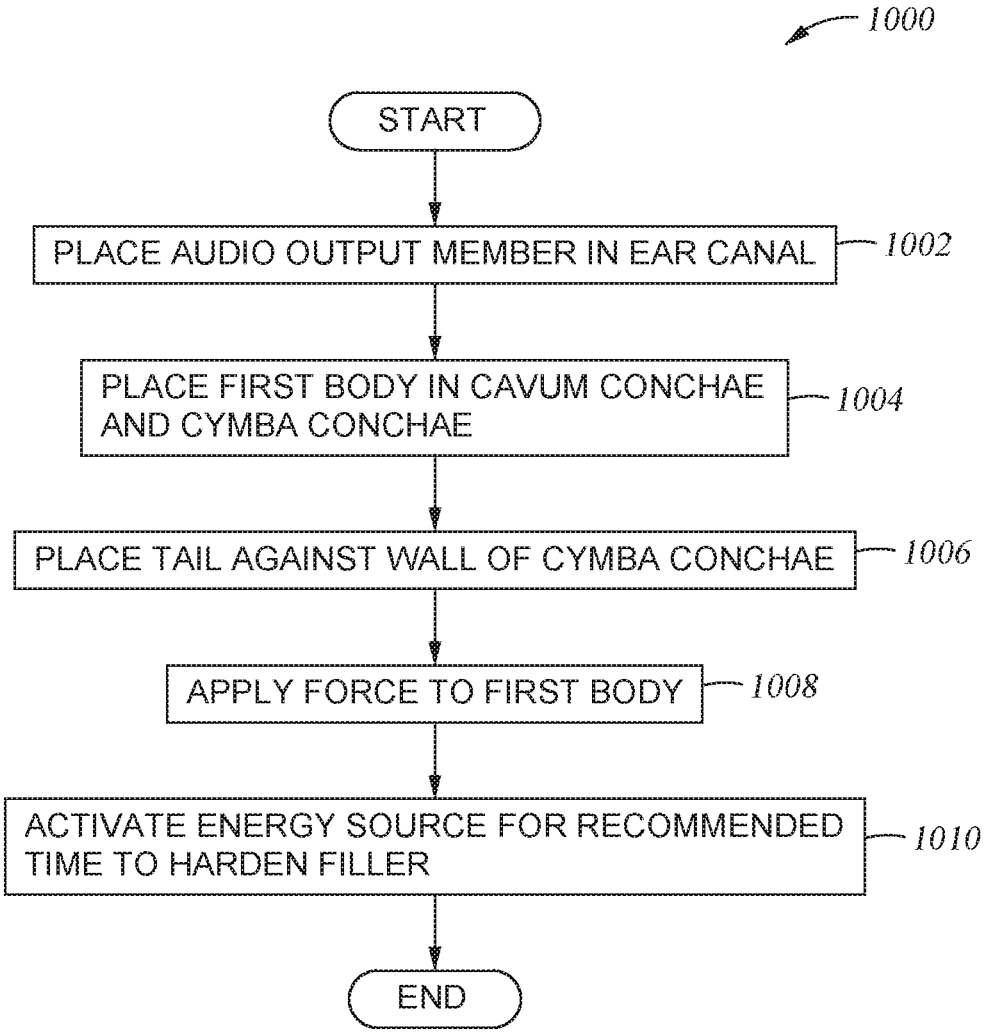
FIG. 3 is a process flow diagram of a method for customizing the earpiece of FIG. 1A to a user's ear, according to one embodiment.

FIG. 3 is a process flow diagram of a method 1000 for customizing the earpiece of FIG. 1A to a user's ear, according to one embodiment. The method 1000 is also referred to herein as generally the curing process. Although the method steps are described in conjunction with the systems of FIGS. 1A-2D, persons skilled in the art will understand that any system configured to perform the method steps, in any order, is within the scope of the present invention.

Referring to FIGS. 1A-3, the method 1000 is described. At block 1002, the user places the audio output member 150 of the earpiece 100 in the user's ear canal 202. For example, the user can place the audio output member 150 in the user's ear canal 202 by orienting the end 155E of the ear tip 155 to be positioned at the entrance of the user's ear canal 202 and then pushing the ear tip 155 into at least a portion of the user's ear canal 202 and slightly towards the user's ear drum (e.g., see the position of the audio output member 150 in FIG. 2B). The end 166E of the sound tube 166 can be substantially facing the user's ear drum (not shown) when the ear tip 155 is positioned into the user's ear canal 202. The base 157 of the audio output member 150 can be facing away from the user's outer ear 200 when the ear tip 155 is positioned into the user's ear canal 202.

In some embodiments of block 1002, the user may select an earpiece 100 that has an audio output member 150 that is initially positioned at an azimuth AZ angle that closely matches a measured or known angle of a user's ear canal. In other embodiments, it is desirable to select an earpiece 100 that has an audio output member 150 that is initially positioned at an azimuth AZ angle that is aligned in a direction that is off-center or non-collinear with an axis of the ear canal so that when the azimuth AZ angle is adjusted during the curing process, a more aligned position with the axis of the ear canal is achieved.

At block 1004, the user places the first body 110 against the user's cavum conchae 203 and cymba conchae 204, so that the first body 110 straddles the crus helix 205 (e.g., see the position of the first body 110 in FIG. 2B).

At block 1006, the user places the flexible tail 135 in the cymba conchae 204 so that it can be pressed against the wall 204W (see FIG. 2C) of the cymba conchae 204 that leads to the crus antihelicis inferioris 214.

At block 1008, the user applies a force or load to the first body 110 to press and urge the first body 110 against portions of the user's outer ear 200, such as the cavum conchae 203, the cymba conchae 204, and the crus helix 205. For example, the user's hand may be used to press and/or urge the first body 110 against these portions of the outer ear 200. The pressure applied by the user causes the elements in the first body 110 to deform and laterally expand, so that a larger portion of the first body 110 contacts one or more of the cavum conchae 203, the cymba conchae 204, the crus helix 205, and the tragus 210. The earpiece 100 can be more suitably retained in the user's outer ear 200 after the flexible material within first body 110 expands to contact a larger surface area of the user's outer ear 200, such as a larger surface area of one or more of the cavum conchae 203, the cymba conchae 204, the crus helix 205, and the tragus 210. The increased surface area of contact between the first body 110 and the user's outer ear 200 increased friction between the earpiece 100 and the user's outer ear 200, which improves the ability to retain the earpiece in the user's ear.

During block 1008, the load applied to the first body 110 will cause the bladder 115 and outer body 114 to distort in a YZ plane (e.g., Y and Z-directions in FIG. 1D). The applied load thus causes the dimensions (e.g., diameter) of the bladder 115 and ring 114A in the Y-Z plane (FIG. 1D) to increase as the user urges the first body 110 against the user's outer ear 200 (e.g., load is applied in the X-direction). The distortion of the bladder 115 and ring 114A then cause the flexible tail 135 and output member 150 to move relative to the first body 110, as discussed above in relation to FIG. 2D, due to the stress induced in these members due to the applied load. Thus, in some embodiments, it is desirable to adjust the cross-sectional shape of the ring 114A and concave feature 114B and material properties of the materials used therein to control the amount of movement of the flexible tail 135 and change in the azimuth AZ angle after performing method 1000.

At block 1010, the energy source 120 is activated to cure the curable filler 116 while the load that is applied during block 1008 to deform the first body 110 is maintained. For example, in one embodiment, the energy source 120 is a UV light source that is activated for a recommended time period (e.g., 60 seconds), so that the deformed curable filler 116 can be cured and thus fixed in the deformed orientation. Curing the curable filler 116 enables the first body 110 to retain its shape after the user removes the applied force during block 1008 and the earpiece 100 is removed from the user's outer ear 200. Also, in some embodiments curing the curable filler 116 can assist in maintaining the orientation of the audio output member 150 relative to the first body 110. For example, the audio output member 150 may be less adjustable in one or more dimensions relative to a stationary first body 110 after activating the energy source 120 to cure the curable filler 116. Furthermore, in some embodiments curing the curable filler 116 may also help maintain the position and orientation of the flexible tail 135 relative to the first body 110 in a relatively fixed orientation.

Therefore, due to the configuration of the bladder 115 and outer body 114 components described herein, and the use of flexible and curable materials used to form these elements, the final orientation of the output member 150, flexible tail 135 and shape of the first body 110 can be adjusted and fixed to better suit and match a user's ear. Therefore, a custom-fit earpiece that includes features providing superior retention in a user's ear while also maintaining desirable comfort and sound quality is formed.

While the foregoing is directed to embodiments of the present disclosure, other and further embodiments of the disclosure may be devised without departing from the basic scope thereof, and the scope thereof is determined by the claims that follow.

What is claimed is:

1. An earpiece for providing sound to a user comprising:

a first body comprising an outer body, a bladder and a curable filler disposed within the bladder, wherein the outer body is configured to support the bladder and the curable filler; and an audio output member comprising a sound tube, wherein the audio output member is coupled to the outer body of the first body at a flexible connection that is positioned there between, and the audio output member is positioned outside of an exterior surface of the bladder; and a flexible tail coupled to the first body at a second location on the first body, wherein the flexible connection is positioned at a first location on the first body.

2. The earpiece of claim 1, wherein an orientation of the audio output member is adjustable in two dimensions relative to the first body.

3. The earpiece of claim 1, further comprising an audio driver disposed within the audio output member and coupled to the sound tube.

4. The earpiece of claim 3, further comprising:

one or more signal processing components that are electrically coupled to the audio driver; and a transceiver that is electrically coupled to the one or more signal processing components, and is configured to provide a signal that is received from an external electronic device to the one or more signal processing components.

5. The earpiece of claim 1, wherein the second location is at least 90 degrees apart from the first location on the first body.

6. The earpiece of claim 1, wherein the curable filler is a photopolymer.

7. The earpiece of claim 1, wherein the earpiece further comprises a UV light source.

8. The earpiece of claim 1, further comprising an outer body disposed around the bladder, wherein the outer body includes a central portion that extends around the bladder, the bladder consists of a first portion and a second portion, the first portion disposed entirely on a first side of the central portion of the outer body and the second portion disposed entirely on the second side of the central portion of the outer body, and the second portion comprises at least 40% of a total volume of the bladder.

9. The earpiece of claim 8, wherein the bladder has a shape of a sphere and the first portion and the second portion are each a hemisphere of the sphere.

10. The earpiece of claim 8, further comprising a flexible tail coupled to the outer body at a second location on the outer body.

11. The earpiece of claim 10, wherein the second location is at least 90 degrees apart from the first location of the first body.

12. A method of customizing an earpiece for use in an outer ear of a user, comprising:

placing an audio output member comprising a sound tube in an ear canal of a user;

placing a first body in a cavum conchae of an outer ear of the user, wherein the first body comprises an outer body, a bladder and a curable filler disposed within the bladder, wherein the outer body is configured to support the bladder and the curable filler, the audio output member is coupled to the outer body of the first body at a flexible connection that is positioned therebetween, and the audio output member is located outside of an exterior surface of the bladder, applying a force to the first body to press the first body against the cavum conchae, wherein the force causes the first body to deform; and placing a flexible tail against a wall of a cymba conchae of the outer ear of the user, wherein the flexible connection is positioned at a first location on the first body, and the flexible tail is coupled to the first body at a second location.

13. The method of claim 12, further comprising activating an energy source to cure the curable filler.

14. The method of claim 12, wherein placing the first body in the cavum conchae further comprises placing the first body in the cymba conchae of the outer ear of the user so that the first body straddles a crus helix of the outer ear of the user.

15. The method of claim 12, wherein applying force to the first body to press the first body against the cavum conchae causes the flexible tail to conform to the wall of the cymba conchae.

16. The method of claim 12, wherein the second location is at least 90 degrees apart from the first location.

17. The method of claim 12, wherein the orientation of the audio output member is less adjustable in one or more dimensions relative to the stationary first body after activating the energy source to cure the curable filler.

18. A method of forming a customized earpiece, comprising:

positioning an earpiece within a portion of an ear of a user, wherein the earpiece comprises a first body that comprises an outer body supporting a bladder, and an audio output member that is coupled to the outer body of the first body at a first location, and wherein positioning the earpiece comprises:

positioning a sound tube of the audio output member in an ear canal of the ear of the user, and the first body in a cavum conchae of the ear of the user;

urging the first body against the cavum conchae, wherein urging the first body against the cavum conchae causes the bladder and the outer body to deform and an angular orientation of the audio output member relative to the ear canal to adjust;

curing a curable filler material disposed within the bladder while urging the first body against the cavum conchae, wherein curing the curable filler material comprises delivering one or more wavelengths of electromagnetic radiation to the curable filler material from an energy source to cause the bladder and the outer body to be fixed in the deformed state; and placing a flexible tail against a wall of a cymba conchae of the ear of the user, wherein the flexible tail is coupled to the first body at a second location.

* * * * *